US007744444B2

(12) United States Patent
Mandel et al.

(10) Patent No.: US 7,744,444 B2
(45) Date of Patent: Jun. 29, 2010

(54) CENTERLESS FEED-THROUGH SUPER-FINISHING DEVICE HAVING A LAPPING SYSTEM CONTAINING A FREELY-DISPOSED ABRASIVE

(75) Inventors: Kostia Mandel, Netanya (IL); Limor Zuri, Haifa (IL); Boris Shamshidov, Or Akiva (IL)

(73) Assignee: Fricso Ltd, Tirat Hakarmel (IL)

( * ) Notice: Subject to any disclaimer, the term of this patent is extended or adjusted under 35 U.S.C. 154(b) by 0 days.

(21) Appl. No.: 12/045,035

(22) Filed: Mar. 10, 2008

(65) Prior Publication Data

US 2008/0220694 A1 Sep. 11, 2008

Related U.S. Application Data

(60) Provisional application No. 60/893,630, filed on Mar. 8, 2007.

(51) Int. Cl.
*B24B 1/00* (2006.01)
*B24B 49/00* (2006.01)

(52) U.S. Cl. ..... 451/11; 451/48; 451/189; 451/194; 451/245

(58) Field of Classification Search ..... 451/11, 451/48, 182, 188, 189, 194, 242, 245, 260
See application file for complete search history.

(56) References Cited

U.S. PATENT DOCUMENTS 2,073,079 A * 3/1937 Theler et al. ..... 451/242
3,970,204 A * 7/1976 Lutz ..... 414/432
5,447,463 A * 9/1995 Schmitz ..... 451/14
7,134,939 B2 * 11/2006 Shamshidov et al. ..... 451/36
2007/0123152 A1 * 5/2007 Shteinvas et al. ..... 451/11
2008/0166214 A1 * 7/2008 Mandel et al. ..... 451/36
2008/0166950 A1 * 7/2008 Mandel et al. ..... 451/164

* cited by examiner

*Primary Examiner*—Maurina Rachuba
(74) *Attorney, Agent, or Firm*—Mark M. Friedman

(57) ABSTRACT

A centerless feed-through super-finishing device including: first and second feed-through rollers having first and second longitudinal outer surfaces; a metallic part having a generally cylindrical section, disposed between the outer surfaces, wherein a longitudinal axis of the cylindrical section is generally aligned with the outer surfaces, the cylindrical section having a metal working surface, the outer surfaces disposed in a near-parallel fashion; a rotating mechanism for rotation of the rollers along respective longitudinal axes thereof, and for effecting thereby a rotation of the cylindrical section, wherein an angle between the rollers is selected such that rotation of the rollers propels the cylindrical section between the rollers; and a lapping system including: a lapping tool having a polymeric contact surface disposed to contact the working surface, and a lapping mechanism, associated with the lapping tool, adapted to exert a load on the contact and working surfaces; and abrasive particles, freely disposed between the contact and working surfaces, wherein the contact surface and the lapping mechanism are adapted, and the abrasive particles are selected, such that the relative motion under the load effects lapping of the working surface, and wherein the surfaces of the rollers are covered with a polymeric material.

7 Claims, 3 Drawing Sheets

CENTERLESS FEED-THROUGH SUPER-FINISHING DEVICE HAVING A LAPPING SYSTEM CONTAINING A FREELY-DISPOSED ABRASIVE

This application draws priority from U.S. Provisional Patent Application Ser. No. 60/893,630, filed Mar. 8, 2007.

FIELD AND BACKGROUND OF THE INVENTION

The present invention relates to centerless feed-through super-finishing devices and methods, and, more particularly, to a centerless feed-through super-finishing device and method having a lapping system for lapping of the outside diameter of a substantially cylindrical surface, the lapping system containing a freely-disposed abrasive.

Centerless feed-through super-finishing devices are known in the art. Such finishing devices utilize a fixed abrasive material (e.g., an abrasive pad, stone or tape) wherein the abrasive particles are fixed in place with respect to the backing or support materials. The fixed abrasive material moves relative to the outer cylindrical surface of the metallic part being processed, so as to abrade and finish the surface. During processing, such devices characteristically develop heat, requiring copious quantities of cooling liquid. The surface of the metallic part being processed must also be flushed to remove abrasive particles liberated from the fixed abrasive material. In the absence of such flushing, the liberated abrasive particles, when caught between a roller and the cylindrical surface of the metallic part, can cause appreciable damage to the finish of the part surface.

Consequently, a centerless feed-through super-finishing device in which the lapping system utilizes a freely-disposed abrasive is a manifestly inferior technology, and is rarely, if at all used in state-of-the-art systems.

SUMMARY OF THE INVENTION

According to the teachings of the present invention there is provided a centerless feed-through super-finishing device including: (a) at least a first feed-through roller having a first longitudinal outer surface; (b) at least a second feed-through roller having a second longitudinal outer surface, (c) a metallic part having a generally cylindrical section, disposed between the outer surfaces, wherein a longitudinal axis of the cylindrical section is generally aligned with the longitudinal outer surfaces, the cylindrical section having a metal working surface, the outer surfaces disposed in a near-parallel fashion, wherein an angle of deviation from a strictly parallel orientation is within a range of 0.5 degrees to 10 degrees; (d) at least one rotating mechanism adapted to effect rotation of the rollers along respective longitudinal axes thereof, and to effect thereby a rotation of the cylindrical section, wherein the angle is selected wherein the rotation of the rollers propels the cylindrical section in a longitudinal direction between the rollers, and (e) a lapping system including: (i) a lapping tool having a polymeric contact surface, the contact surface disposed to contact the metal working surface, the contact surface including an organic and/or polymeric material, and (ii) a lapping mechanism, associated with the lapping tool, adapted to exert a load on the contact surface and the working surface, and (f) a plurality of abrasive particles, the abrasive particles freely disposed between the contact surface and the working surface, the contact surface for providing an at least partially elastic interaction with the plurality of abrasive particles, and wherein the contact surface and the lapping mechanism are adapted, and the plurality of particles is selected, wherein upon activation of the lapping mechanism, the relative motion under the load effects lapping of the metal working surface, and wherein at least a portion of the first and second longitudinal outer surfaces of the feed-through rollers is covered with a polymeric material to form covered outer surfaces.

According to further features in the described preferred embodiments, the lapping mechanism is further adapted to apply a relative motion between the contact surface and the metal working surface, the relative motion oriented along the longitudinal axis of the cylindrical section.

According to still further features in the described preferred embodiments, more than 50% of the first and second longitudinal outer surfaces of the feed-through rollers is covered with the polymeric material, and preferably, all or substantially all of these surfaces are covered with the polymeric material.

According to still further features in the described preferred embodiments, the covered outer surfaces have a Shore D hardness below 90.

According to still further features in the described preferred embodiments, the covered outer surfaces have a Shore D hardness in a range of about 70 to about 90.

According to still further features in the described preferred embodiments, the covered outer surfaces have a Shore D hardness in a range of about 75 to about 85.

According to still further features in the described preferred embodiments, the polymeric contact surface has a Shore D hardness in a range of about 60 to about 90.

According to still further features in the described preferred embodiments, the device further includes: (g) a feed mechanism, associated with the lapping system, the feed mechanism adapted to feed the abrasive particles between the contact surface and the working surface in an automatic, controlled fashion.

According to still further features in the described preferred embodiments, the polymeric contact surface is part of a contact area component, the lapping tool has a base component associated with the contact area component, and wherein a hardness of the base component is greater than a hardness of the polymeric contact surface.

According to still further features in the described preferred embodiments, between contact area component and the base component is disposed a flexible polymeric layer having a lower hardness than the contact surface, and a lower hardness than the base component.

According to still further features in the described preferred embodiments, the flexible polymeric layer has a Shore D hardness below 50.

According to still further features in the described preferred embodiments, the flexible polymeric layer has a Shore D hardness below 45.

According to still further features in the described preferred embodiments, the flexible polymeric layer has a Shore D hardness below 40.

According to still further features in the described preferred embodiments, the flexible polymeric layer is disposed in a generally parallel orientation with respect to the contact surface.

According to still further features in the described preferred embodiments, the flexible polymeric layer has a thickness in a range of 1.5-7 mm.

According to still further features in the described preferred embodiments, when the abrasive particles become disposed between the covered outer surfaces and the metal working surface, the covered outer surfaces are sufficiently pliable to at least partially absorb the abrasive particles, thereby obviating a need for a washing system to wash away the abrasive particles. Thus, the system of the present invention may advantageously have no such washing system.

According to another aspect of the present invention there is provided a method of super-finishing a metal surface of a workpiece, the method including the steps of: (a) providing the above-described super-finishing device; (b) operating the rotating mechanism to effect the rotation of the rollers and the cylindrical section, and (c) operating the lapping mechanism to exert the load on the contact surface and the working surface, so as to effect super-finishing of the working surface of the cylindrical section by the abrasive particles.

According to further features in the described preferred embodiments, the method includes (d) applying a relative motion between the contact surface and the metal working surface, the relative motion oriented along the longitudinal axis of the cylindrical section.

According to still further features in the described preferred embodiments, the Shore D hardness of the covered outer surfaces is selected within in a range of 70 to 90, to achieve an average roughness ($R_a$) below 0.1, and more typically, below 0.07, and even below 0.05.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. Throughout the drawings, like-referenced characters are used to designate like elements.

In the drawings.

DESCRIPTION OF THE PREFERRED EMBODIMENTS

Figure 1A:
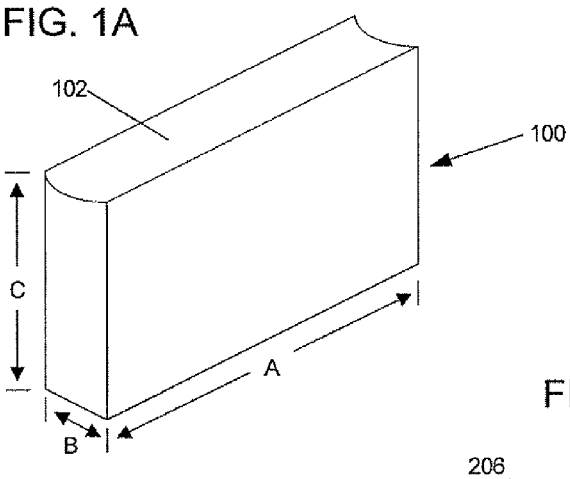
FIG. 1A is a schematic representation of a lapping tool adapted for lapping, by means of a freely-disposed abrasive, an outside diameter of a component.

One aspect of the present invention is a centerless feed-through super-finishing device using unspent, freely disposed abrasive particles.

The principles and operation of the centerless feed-rough super-finishing device according to the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

As used herein in the specification and in the claims section that follows, the term "freely disposed abrasive" and the like is meant to specifically exclude fixed abrasives, as well as fragments of fixed abrasives that have been detached from the fixed abrasive pad or supporting material.

Similarly, as used herein in the specification and in the claims section that follows, the term "unspent abrasive particles" is meant to specifically exclude abrasive particles or fragments that have become detached from the fixed abrasive pad or supporting material.

As used herein in the specification and in the claims section that follows, the term "super-finishing", with respect to a centerless feed-through device, refers to a device that characteristically achieves a lower average roughness ($R_a$) with respect to centerless feed-through finishing devices, and more specifically, achieves an $R_a$ that is below 0.1, more typically, below 0.07, and often below 0.05.

Figure 1B:
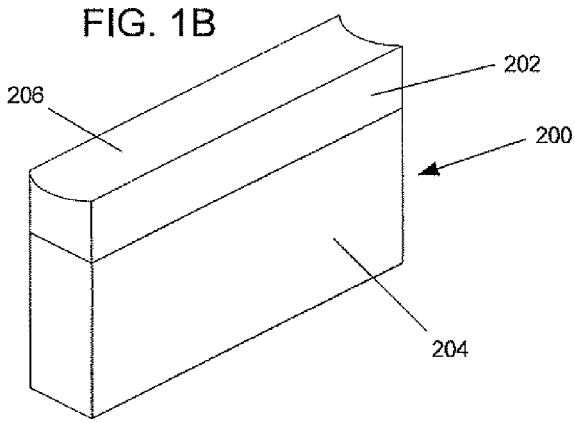
FIG. 1B is a schematic representation of a cylindrical element or part that is suitable for being lapped by a centerless feed-through super-finishing device of the present invention.

Referring now to the drawings, FIG. 1A provides one embodiment of a centerless feed-through super-finishing device 100 of the present invention. Lapping tool 100 is adapted for lapping an outside diameter or surface of a metallic part or component having a generally cylindrical section, such as a cylinder 300 shown in FIG. 1B. Lapping tool 100 is essentially a cube, a cubic rectangle or a box-shaped device, having a length A, a width B and a height C. Length A may be about twice the length of width B, and height C may be about half of width B.

The top side of lapping tool 100 includes a contact area or surface 102, which may be symmetrically or asymmetrically concave. The radius of the concavity of the contact area 102 may be approximately equal to the radius of a cylinder, such as cylinder 300, such that as the lapping treatment is being conducted, a substantial portion of contact area 102 (up to the entire surface area of contact area 102) may be in contact with an outside surface 302 of cylinder 300. Initially (i.e., prior to contact with outside surface 302), the concavity of contact area 102 may have a radius smaller or larger than the radius of cylinder 300. Contact area 102 may lack concavity altogether. As the treatment progresses, contact area 102 may self-form (or self-align) to an approximate or exact radius of cylinder 300. Alternatively, contact area 102 may retain essentially its original shape over the course of treatment of outside surface 302.

In the embodiment of lapping tool 100 described above and shown in FIG. 1A, lapping tool 100 is often made of a single piece of polymeric material.

Figure 1C:
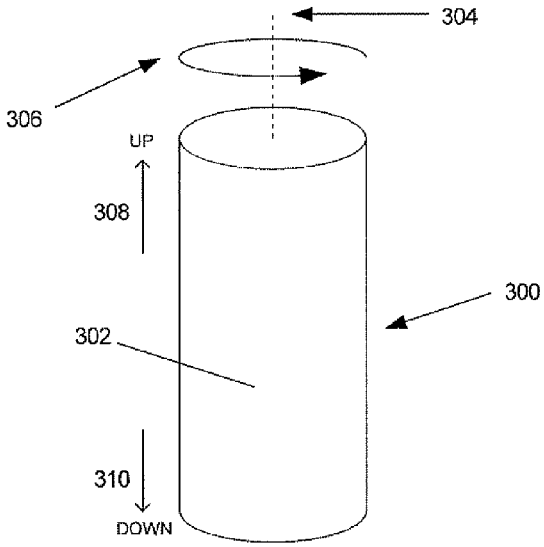
FIG. 1C is a schematic representation of a lapping tool having at least two sub-sections, including a base component and a working area component.

In another embodiment, lapping tool 200, more fully shown in FIG. 1C, may have an external shape essentially similar or identical to that of the embodiment of the lapping tool 100 described in relation to FIG. 1A, but lapping tool 200 may include two or more sub-sections. Each sub-section may be made of similar or different materials. For example, a surface treatment region, such as contact area component 202 having a contact area 206, may be made of a polymeric material; a supporting or structural component, such as base component 204 may be made of at least one structural or rigid material such as metal, polymer (harder than the polymeric material of contact area component 202), ceramic, wood and the like. One advantage of forming lapping tool 200 with two or more sub-sections is the relative high cost of some polymeric materials that may be used to shape, form, or otherwise embody (hereinafter referred to as "form") base component 204, compared to the possible cost of other rigid materials that may form contact area component 202 or other sub-sections of lapping tool 200. Another advantage may be the functional need to add rigidity and/or support to lapping tool 200; since the polymeric material that forms contact area component 202 may be less mechanically-stable compared to other rigid materials, using such rigid materials to form base component 204 may add rigidity and support to the lapping tool, such as those shown at 100 and 200 in FIGS. 1A and 1C, respectively.

Figure 1D:
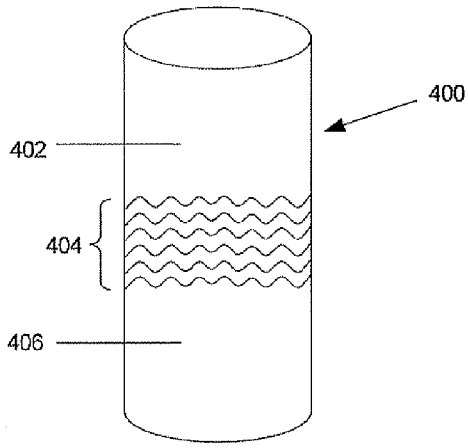
FIG. 1D is a schematic representation of a lapping tool having at least three sub-sections, including a base section, a working area section or layer, and a relatively flexible section or layer disposed therebetween.

In another embodiment shown in FIG. 1D, lapping tool 250 may have an external shape essentially similar or identical to that of the embodiment of the lapping tool 200 described in relation to FIG. 1C. As in FIG. 1C, contact area component 202 has a contact area or surface 206 made of a polymeric material. Typically, contact area component 202 in its entirety is made of such polymeric material. Base component 204 is made of at least one structural or rigid material such as metal, polymer (harder than the polymeric material of contact area component 202), ceramic, wood and the like.

However, in contrast to the embodiment provided to FIG. 1C, in between contact area component 202 and base component 204 is disposed a flexible layer 203, preferably including, or made of, a soft polymeric material. Flexible layer 203 is preferably oriented in a generally parallel manner with respect to contact surface 206.

Flexible layer 203 preferably has a lower hardness than contact surface 206, and a much lower hardness than base component 204. Preferably, the Shore D hardness of flexible layer 203 is about or below 50, and more preferably, about or below 40.

Flexible layer 203 may have a thickness that is less than 10 mm. Preferably, the thickness of flexible layer 203 is 1.5-7 mm, and more preferably, 2-6 mm.

Surprisingly good results have been obtained using lapping tool 250. Without wishing to be limited by theory, the inventors believe that the disposition of flexible layer 203 in intermediate position between contact area component 202 and base component 204 effects absorption of various forces generated by the interaction of contact surface 206 and a working surface of a workpiece, such as working surface 132 shown in FIGS. 2 and 2A.

Figure 2:
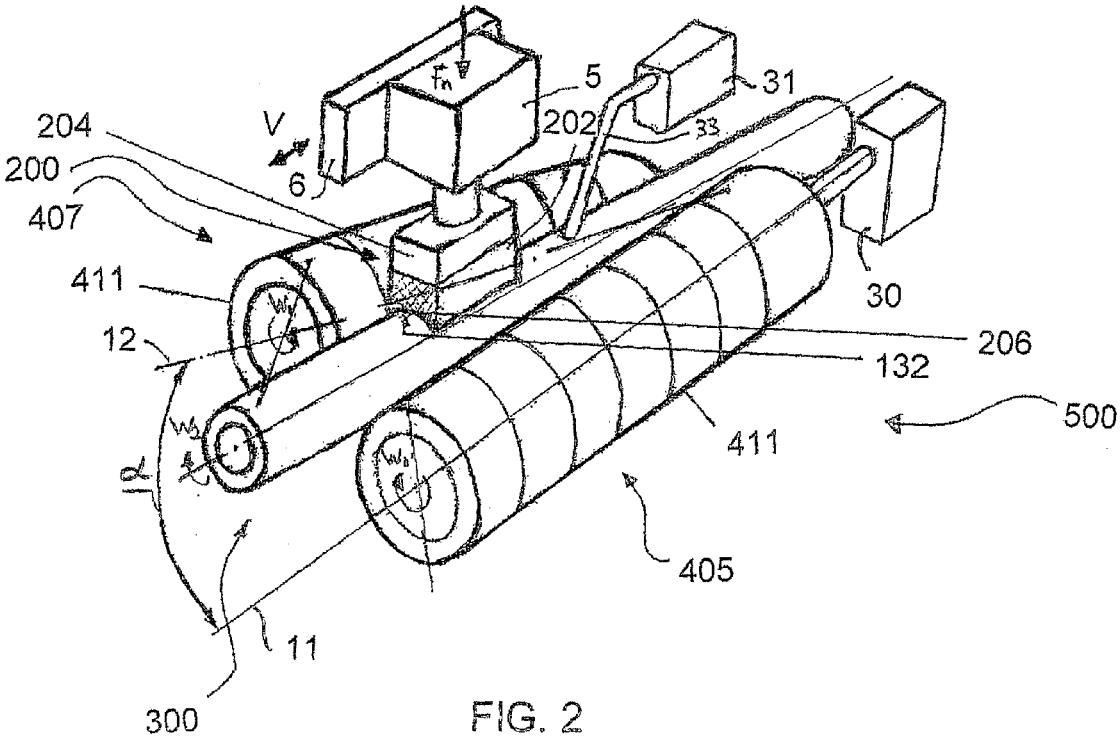
FIG. 2 is a schematic perspective representation of the inventive centerless feed-through super-finishing system, wherein the system includes a lapping system using an unspent, freely-disposed abrasive.

FIG. 2 is a schematic perspective representation of the inventive centerless feed-through super-finishing system 500. System 500 includes a lapping tool such as lapping tool 200, attached to a mechanism including mechanism 6 that preferably causes a working surface 132 of a cylinder 300 and a corresponding contact surface 206 of lapping tool 200 to move in a relative, reciprocating motion. This relative motion, which is generally along a longitudinal axis of cylinder 300, has an instantaneous velocity having a magnitude V. Lapping tool 200 is also associated with a mechanism including mechanism 5 that exerts a load, or a pressure, that is preferably substantially normal to contact surface 206 and working surface 132.

An abrasive paste containing abrasive particles is freely disposed between working surface 132 and contact surface 206. The composition and size distribution of the abrasive particles are selected so as to readily wear down working surface 132 according to plan, such as reducing surface roughness so as to achieve a pre-determined finish. The paste may be a conventional paste used in conventional lapping processes. In order to be effective, the abrasive grit is preferably harder than both working surface 132 and contact surface 206. Aluminum oxide has been found to be a particularly suitable abrasive material for a variety of lapping surfaces and working surfaces, in accordance with the invention.

Those skilled in the art will appreciate that mechanisms 5 and 6 may be chosen from various known and commercially available mechanisms for use in conjunction with lapping systems. The rollers may be smooth, or may have recesses for trapping debris, as is known in the art.

Associated with lapping tool 200 are feed-through rollers 405, 407, adapted such that cylinder 300 is disposed therebetween. Feedthrough rollers 405, 407, each having an outside surface 411, are disposed so as to be largely parallel with respect to cylinder 300, when working surface 132 of cylinder 300 is engaging contact surface 206. As known in the art, feed-through rollers 405, 407 are disposed so as to deviate, by a slight angle $\alpha$, from being exactly parallel with respect to each other, such that a rotation of rollers 405, 407 about their respective longitudinal axes 11, 12 at a radial speed of $\omega 1$ propels cylinder 300 between rollers 405, 407. The angle $\alpha$, as shown in FIG. 2, is the angle of deviation from a strictly parallel orientation between rollers 405, 407, and is typically within a range of 0.5 degrees to 10 degrees, more typically, 1 degree to 3 degrees. The rotation of rollers 405, 407 also induces cylinder 300 to rotate about its longitudinal axis at an angular speed of $\omega 2$. Consequently, as cylinder 300 is advanced between rollers 405, 407, the entire external surface area of cylinder 300 can undergo surface super-finishing treatment by means of contact surface 206 of lapping tool 200.

Rotation of rotation of rollers 405, 407 about their respective longitudinal axes 11, 12 is advantageously performed by means of a rotation mechanism such as rotation mechanism 30 connected to feed-through roller 405 (rotation mechanism of feed-through roller 407 not shown).

One embodiment of the present invention is a centerless feed-through super-finishing device in which the lapping system utilizes an unspent, freely disposed abrasive. We have surprisingly discovered that by forming outside surface 411 of a polymeric material having specific mechanical properties, the tribological characteristics of the outside diameter of cylinder 300 are not compromised, substantially, when the freely-disposed abrasive particles are caught between the moving roller and the cylindrical surface of the metallic part or element. Without wishing to be limited by theory, we believe that as the roller exerts a force on the cylindrical surface, the polymeric material is sufficiently pliable to at least partially absorb the freely-disposed abrasive particles, thereby inhibiting, or at least greatly reducing, gouging or scraping of the cylindrical surface.

Moreover, we have further discovered that the presence of the polymeric material on the rollers has a surprisingly advantageous effect on the feed-through action of the device and on the induced rotation of the cylindrical part. The rollers, when covered by the polymeric material so as to have the mechanical properties described herein, achieve an increased contact area with the cylindrical surface of the metallic part, which results in correspondingly increased frictional forces with the cylindrical surface. Consequently, it is possible to apply significantly greater force on the cylindrical surface, with respect to conventional rollers.

This may be important for various reasons. One particularly significant ramification relates to the lapping of the cylindrical surface. In our development work, we found that the integration of a lapping mechanism and a freely disposed abrasive in a centerless feed-through super-finishing device was fraught with problems. Perhaps the most significant of these problems was that in applying the lapping mechanism to achieve the desired surface effects on the cylindrical surface, the frictional forces exerted on the cylindrical surface by the lapping mechanism were of a magnitude that was detrimental to the performance of the device.

More specifically, the contact surface of the lapping mechanism exerts frictional forces on the cylindrical surface, forces that operate against both the longitudinal feed-through motion and the induced rotational motion of the cylindrical surface. These frictional forces hampered, or even brought to a standstill the longitudinal and/or the rotational movement of the cylindrical part. However, we discovered that the increased frictional forces provided by the inventive polymeric roller surface on the cylindrical surface enable the roller system to apply significantly greater force on the cylindrical surface, with respect to conventional rollers, so as to enhance both the rotational motion and the longitudinal feed-through motion of the cylindrical surface of the part. Thus, the inventive roller surface actually makes the lapping of the freely-disposed particles into a viable process, or at the least, appreciably enhances the viability thereof.

A feed mechanism 31 may be used to deliver abrasive particles, typically in a slurry or paste, to working surface 132. Feed mechanism 31 may include a transport mechanism such as a pump, a reservoir for storing the medium containing the abrasive particles, and a dispensing tube 33 for delivering the medium to working surface 132.

Feed mechanism 31 may be advantageously disposed such that dispensing tube 33 passes through lapping tool 200, so as to deliver the abrasive medium directly to the region between working surface 132 and contact surface 206.

Figure 2A:
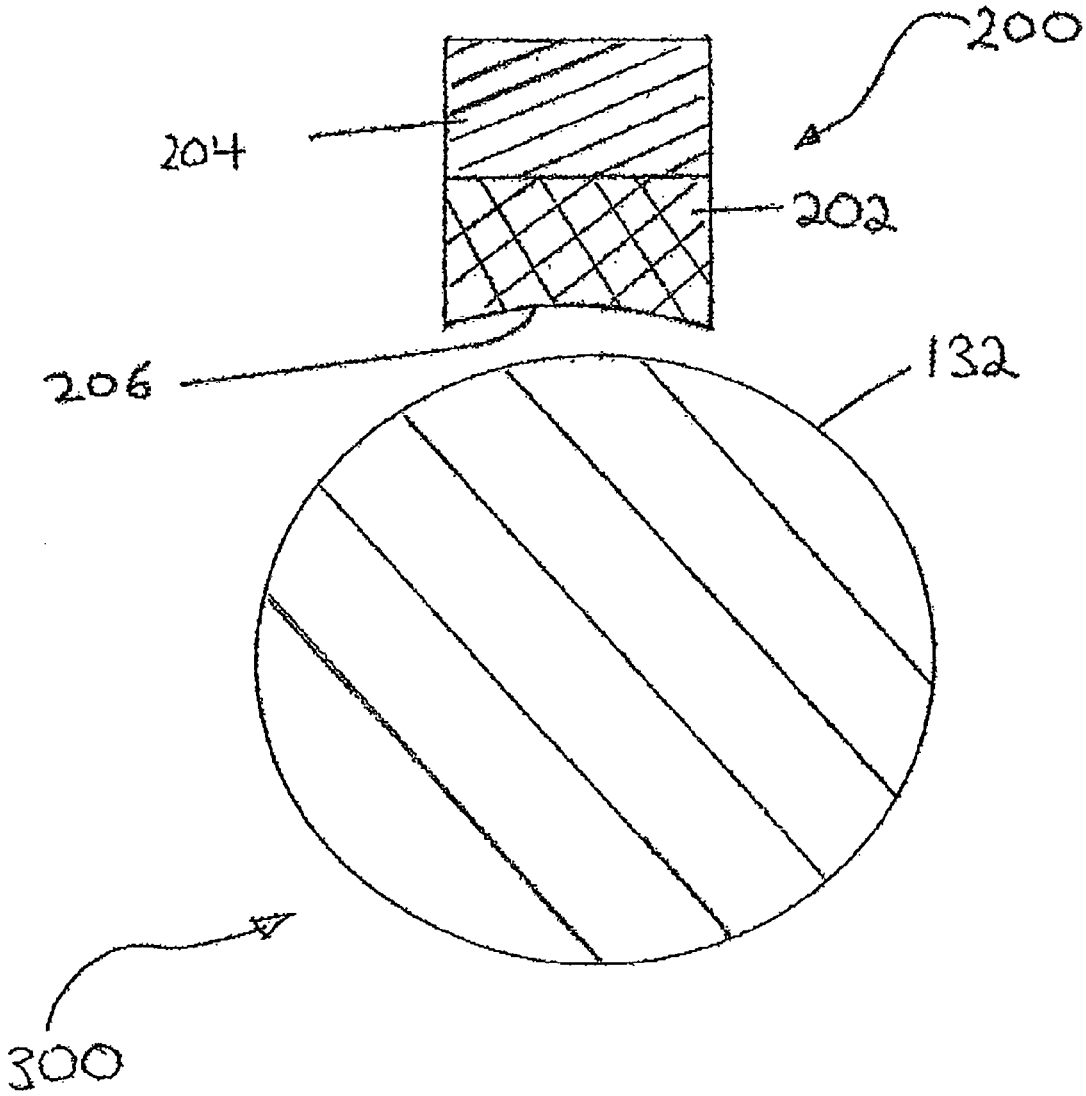
FIG. 2A is a schematic cross-sectional representation of the lapping tool of FIG. 1C and a cylindrical section of the part or workpiece.

FIG. 2A is a schematic cross-sectional representation of the lapping tool of FIG. 1C and a cylindrical section of part or workpiece 300. Lapping tool 200 includes base component 204 and contact area component 202 having contact area 206. Opposite to contact area 206 is disposed working surface 132 of workpiece 300. In between contact area 206 and working surface 132 are disposed a large plurality of abrasive particles (not shown), typically in a paste. The paste may be a conventional paste used in conventional lapping processes. In order to be effective, the abrasive grit is harder than the face of the lapping tool, and harder than the processed working surface. Aluminum oxide has been found to be a particularly suitable abrasive material for a variety of lapping surfaces and working surfaces, in accordance with the invention. The composition and size distribution of the abrasive particles are selected so as to readily wear down working surface 132 according to plan, such as reducing surface roughness to a pre-determined roughness.

Single stage treatments are performed using a substantially neutral (pH between 6 and 8) and substantially chemically inert alumina-based paste containing alumina particles typically having an average particle size of about 5-10 micrometers.

Typically, the alumina used in the abrasive pastes used in the inventive lapping process is fused alumina. However, as used herein in the specification and in the claims section that follows, the term "alumina" refers to all forms of alumina, including fused alumina, unfused alumina, alpha alumina, gamma alumina, and natural alumina or alumina-containing materials such as corundum and emery.

More generally, other pastes containing inorganic abrasives can be used in conjunction with the inventive lapping process and inventive contact surface to produce the inventive working surface. Although experimentation is ongoing, one common denominator of the incorporated inorganic abrasive particles is hardness: the hardness should be at least 8 on the Mohs scale. The presently preferred hardness is 8 to 9.5, inclusive.

The inorganic abrasive particles disposed in the working agents such as the (unspent) abrasive pastes used in conjunction with the present invention typically have a well-defined particle size distribution (PSD). The average particle size (APS) of the inorganic abrasive particles, and more particularly, alumina, is typically 4-15 micrometers, and more typically, 4-11 micrometers. Abrasive pastes having an APS of as little as 3 micrometers and up to 20 micrometers have been used successfully in some applications. Below an APS of 2 micrometers, the abrasive particles tend to be small with respect to the peaks of the working piece surface, such that the lapping process is greatly compromised, and is impractical. Below an APS of 1-2 micrometers for the abrasive particles, the lapping is substantially ineffectual.

Moreover, the incorporation of the free, hard abrasive particles is particularly enhanced when the inorganic abrasive particles in the abrasive paste, and more particularly, alumina particles in the abrasive paste, have an APS of at least 3 micrometers, typically 4-15 micrometers, and often, 4-11 micrometers.

The abrasive pastes used in conjunction with the present invention are typically oil-based pastes, and are generally commercially available. Typical suppliers and products are provided below:

1. Kemet (UK): green silicon carbide paste, black silicon carbide paste, white aluminum oxide paste. (http://www.flatlap.co.uk/consumables.asp)
2. US Products (USA): white aluminum oxide, Borazon CBN lapping compound, diamond lapping compound. (https://www.us-products.com/sitehtml/products/compslurphp)
3. St. Gobain (USA): diamond abrasive compounds. (http://www.amplexabrasives.com/Data/Element/Node/Category/category_edit.asp?ele_ch_id=C0000000000000002217)

The present invention may advantageously be used in the surface treatment of a wide variety of cylindrical and cylinder-like products, including, but not limited to, piston pins and rods.

Various polymeric materials may have a suitable balance of mechanical properties (e.g., hardness vs. abrasion-resistance) to produce a cylinder surface having such improved tribological characteristics. The presently preferred hardness of the polymeric material forming outside surface 411 is less than about 90 on the Shore D scale. More preferably, the Shore D hardness is about 70 to about 90, yet more preferably, about 75 to about 85, and most preferably, the Shore D hardness is around 80.

The application of polymer coatings on cylinders such as metal cylinders is practiced in various industries, for example, in the printing industry, and in the chemical industry for corrosion protection. It will be appreciated by one skilled in the art, however, that such coatings require complicated multiple processing stages, with significant material and processing costs associated therewith. For these and other reasons, the use of polymer-coated feed-through is unknown, to the best of our knowledge, in centerless feedthrough super-finishing devices.

Table 1 provides some typical materials—along with key mechanical and physical properties thereof—used for coating metallic cylinders. The hardness of these materials is given in the Shore A to Shore D scales. Thus, by way of example, polyurethane-based coatings typically have a minimum hardness of 30 on the Shore A scale, and a maximum of 80 on the Shore D scale.

TABLE 1

| | Polyurethane | Silicon | Polychloroprene | EPDM | Nitrile |
|---|---|---|---|---|---|
| Hardness | 30A to 80D | 50A to 70A | 40A to 90A | 58A to 85A | 40A to 90A |
| Abrasion Resistance | Excellent | Poor | Excellent | Good | Good |
| Max. Working Temp. (C.) | 100 | 260 | 120 | 170 | 120 |

Presently preferred polymeric materials for outside surface 411 include polyurethanes, acetals, as well as polymeric materials containing polyurethanes and/or acetals. Presently preferred polymeric materials may also include some epoxy-based materials. The polymeric material forming surface 411 may be made of compositions similar to, or substantially identical to, the contact surface of the lapping tool. Exemplary compositions are provided hereinbelow.

With regard to the composition of the contact surface of the lapping tool, the inventors have found that a mixture of epoxy cement and polyurethane in a ratio of about 25:75 to 90:10, by weight, is suitable for forming the elastic, organic, polymeric contact surface of the lapping tool. In the epoxy cement/polyurethane mixture, the epoxy provides the hardness, whereas the polyurethane provides the requisite elasticity and wear-resistance. It is believed that the polyurethane also contributes more significantly to the deposition of an organic, possibly polymeric nanolayer on at least a portion of the working surface. It will be appreciated by one skilled in the art that the production of the epoxy cement/polyurethane mixture can be achieved using known synthesis and production techniques.

More preferably, the weight ratio of epoxy cement to polyurethane ranges from about 1:2 to about 2:1, and even more preferably, from about 3:5 to about 7:5.

In terms of absolute composition, by weight, the lapping tool surface typically contains at least 10% polyurethane, preferably, between 20% and 75% polyurethane, more preferably, between 40% and 75% polyurethane, and most preferably, between 40% (inclusive) and 65% (inclusive).

The contact surface of the lapping tool may contain epoxy, preferably, at least 10% epoxy (by weight), more preferably, at least 35% epoxy, yet more preferably, at least 40% epoxy, and most preferably, between 40% (inclusive) and 70% (inclusive). In some applications, however, the elastic layer should preferably contain, by weight, at least 60% epoxy, and in some cases, at least 80% epoxy.

Preferably, the contact surface (lapping surface) should have the following combination of physical and mechanical properties:

Shore D hardness within a range of 50-90, preferably 60-90, more preferably 65-82, and most preferably, 70-80;

impact resistance (with notch) within a range of 3-20 kJ/m$^2$, preferably 3-12 kJ/m$^2$, more preferably 4-9 kJ/m$^2$, and most preferably, 5-8 kJ/m$^2$, according to ASTM STANDARD D 256-97;

It should be appreciated that a variety of materials or combinations of materials could be developed, by one skilled in the art, that would satisfy these physical and mechanical property requirements.

An exemplary lapping tool surface for use in accordance with the present invention is synthesized as follows: an epoxy resin, a polyol and a di-isocyanate are reacted at a temperature exceeding room temperature and less than about 150° C. Subsequently, a hardener is mixed in. As will be evident to one skilled in the art, the requisite curing conditions depend largely upon the particular qualities and ratios of the above-mentioned ingredients. It will be further evident to one skilled in the art that the polymer can be produced as a bulk polymer or as a molded polymer.

While advantageous ratios of the epoxy and polyurethane materials have provided hereinabove and in the claims section hereinbelow, it should be appreciated that other polymers or combinations of polymers having the requisite mechanical and physical properties for use in conjunction with the inventive device and method could be developed by one skilled in the art.

A successful approach to polymer lapping is provided in co-pending U.S. patent application Ser. No. 11/972,014, which is incorporated by reference for all purposes as if fully set forth herein.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification, are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A centerless feed-through super-finishing device comprising:

(a) at least a first feed-through roller having a first longitudinal outer surface;

(b) at least a second feed-through roller having a second longitudinal outer surface, (c) a metallic part having a generally cylindrical section, disposed between said outer surfaces, wherein a longitudinal axis of said cylindrical section is generally aligned with said longitudinal outer surfaces, said cylindrical section having a metal working surface, said outer surfaces disposed in a near-parallel fashion, wherein an angle of deviation from a strictly parallel orientation between said outer surfaces is within a range of 0.5 degrees to 10 degrees;

(d) at least one rotating mechanism adapted to effect rotation of said rollers along respective longitudinal axes thereof, and to effect thereby a rotation of said cylindrical section, wherein said angle is selected wherein said rotation of said rollers propels said cylindrical section in a longitudinal direction between said rollers, and (e) a lapping system including:

(i) a lapping tool having a polymeric contact surface, said contact surface disposed to contact said metal working surface, said contact surface including a polymeric material, and (ii) a lapping mechanism, associated with said lapping tool, adapted to exert a load on said contact surface and said working surface, and (f) a plurality of abrasive particles, said abrasive particles freely disposed between said contact surface and said working surface, said contact surface for providing an at least partially elastic interaction with said plurality of abrasive particles, and wherein said contact surface and said lapping mechanism are adapted, and said plurality of particles is selected, wherein upon activation of said lapping mechanism, said relative motion under said load effects lapping of said metal working surface, and wherein at least a portion of said first and second longitudinal outer surfaces of said feed-through rollers is covered with a polymeric material to form covered outer surfaces, and wherein said polymeric contact surface is part of a contact area component, said lapping tool has a base component associated with said contact area component, and wherein a hardness of said base component is greater than a hardness of said polymeric contact surface, and wherein between contact area component and said base component is disposed a flexible polymeric layer having a lower hardness than said contact surface, and a lower hardness than said base component.

2. The device of claim 1, wherein said flexible polymeric layer has a Shore D hardness below 50.

3. The device of claim 1, wherein said flexible polymeric layer has a Shore D hardness below 45.

4. The device of claim 1, wherein said flexible polymeric layer has a Shore D hardness below 40.

5. The device of claim 1, wherein said flexible polymeric layer is disposed in a generally parallel orientation with respect to said contact surface.

6. The device of claim 1, wherein said flexible polymeric layer has a thickness in a range of 1.5-7 mm.

7. The device of claim 1, wherein said flexible polymeric layer has a thickness in a range of 2-6 mm.

* * * * *